US005343955A

United States Patent [19]

Williams

[11] Patent Number: 5,343,955

[45] Date of Patent: Sep. 6, 1994

[54] TANDEM WELLBORE SAFETY VALVE APPARATUS AND METHOD OF VALVING IN A WELLBORE

[75] Inventor: Ronald D. Williams, Morris, Okla.

[73] Assignee: Baker Hughes Incorporated, Houston, Tex.

[21] Appl. No.: 107,424

[22] Filed: Aug. 16, 1993

Related U.S. Application Data

[63] Continuation of Ser. No. 875,635, Apr. 28, 1992, abandoned.

[51] Int. Cl.[5] ..... E21B 34/10

[52] U.S. Cl. ..... 166/386; 166/321; 166/323; 166/375

[58] Field of Search ..... 166/323, 321, 375, 386

[56] References Cited

U.S. PATENT DOCUMENTS

| | | | |
|---|---|---|---|
| 4,273,194 | 6/1981 | Pringle et al. | 166/323 |
| 4,407,363 | 10/1983 | Akkerman | 166/183 |
| 4,469,179 | 9/1984 | Crow et al. | 166/319 |
| 4,475,599 | 10/1984 | Akkerman | 166/323 |
| 4,796,705 | 1/1989 | Carmody et al. | 166/323 |
| 4,838,355 | 6/1989 | Leismer et al. | 166/375 |
| 4,951,753 | 8/1990 | Eriksen | 166/375 |
| 5,167,284 | 12/1992 | Leismer | 166/323 X |

OTHER PUBLICATIONS

Duncan E. Nuttall, "Safety Systems in Subsea Completions", Journal of Petroleum Technology, Jan. 1991, U.S.A.

William A. Blizzard, "The Tandem Safety Valve Solution: Enhancing Subsea Economics", Jun. 1988, Norway.

*Primary Examiner*—Hoang C. Dang

*Attorney, Agent, or Firm*—Melvin A. Hunn; Mark D. Perdue

[57] ABSTRACT

A tandem safety valve for use in a tubing string in a wellbore has a pair of identical valves disposed in a valve housing. Each valve has a flow tube for selectively opening and closing each valve. Each valve is provided with an hydraulic normal-operation actuator and an hydraulic looking actuator. The normal-operation actuator and locking actuator are selectively engaged with the flow tube disposed within the valve housing. Each flow tube is provided with a latch to releasably engage the normal-operation actuator, and a a locking dog to selectively engage the flow tube in a locked-open position. The locking actuator engages the latch to release the normal-operation actuator from engagement with the latch and to permit the locking dog to engage the valve housing to maintain the flow tube and valve in a locked-open position.

40 Claims, 10 Drawing Sheets

SECTION A--A

SECTION B--B

SECTION A--A

SECTION B--B

SECTION A--A

SECTION B--B

TANDEM WELLBORE SAFETY VALVE APPARATUS AND METHOD OF VALVING IN A WELLBORE

This application is a continuation of application Ser. No. 07/875,635, filed Apr. 28, 1992, now abandoned.

BACKGROUND OF THE INVENTION

1. Field of the Invention

The present invention relates generally to wellbore valves, and specifically to tandem safety valves for use in a producing oil and gas wellbores.

2. Description of the Prior Art

Safety valves are provided in producing oil and gas wellbores to control the flow of production fluids, and are especially important in shutting-in the flow from the oil and gas well in the event a loss of control occurs. All prudent operators of oil and gas wells require a functioning safety valve in wells to ensure the safety of personnel, as well as to protect the economic value of the well. When a safety valve no longer operates properly, it must be replaced, typically by using a workover rig to pull the production tubing to allow replacement, but in subsea wells, pulling production tubing is so costly that instead an expensive wireline operation is usually performed to place a safety valve within the central bore of the production tubing.

It is advantageous, therefore, to provide a tandem safety valve having a valve in a mechanism wherein one of the tandem valves may be normally selectively opened and closed through selective application of fluid pressure to a valve actuator, and wherein the other of the tandem valves may be selectively locked into an open position without maintenance of hydraulic actuation pressure on the locking actuator.

SUMMARY OF THE INVENTION

It is an object of the present invention to provide a tandem safety valve for use in a tubing string in a wellbore wherein one of the valves may be normally operated by application of fluid pressure through an hydraulic actuator, and another of the valves may be maintained in locked-open position without the continued application of fluid pressure through an hydraulic locking actuator.

This and other objects of the present invention are accomplished by providing a tandem safety valve for use in a tubing string in a wellbore, the tandem safety valve having a pair of identical valves disposed in a valve housing, each valve having a flow tube for selectively opening and closing each valve. Each valve is provided with an hydraulic normal-operation actuator and an hydraulic locking actuator. The normal-operation actuator and locking actuator are selectively engaged with a flow tube disposed within the valve housing. Each flow tube is provided with a latch to releasably engage the normal-operation actuator, and a locking dog to selctively engage the flow tube in a locked open position. The locking actuator engages the latch to release the normal-operation actuator from engagement with the latch and to permit the locking dog to engage the valve housing to maintain the flow tube and valve in a locked-open position.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIGS. 6(*a*), 6(*b*) and 7 are views of the normal-operation actuator and the locking actuator in closed positions;

FIG. 8 is a view of the normal-operation actuator in an open position;

FIG. 9 is a view of the normal-operation cylinder in an open position and the locking actuator extending outward;

FIG. 10 is a view of the locking actuator in a fully extended position; and

DETAILED DESCRIPTION OF THE INVENTION

Figure 1:
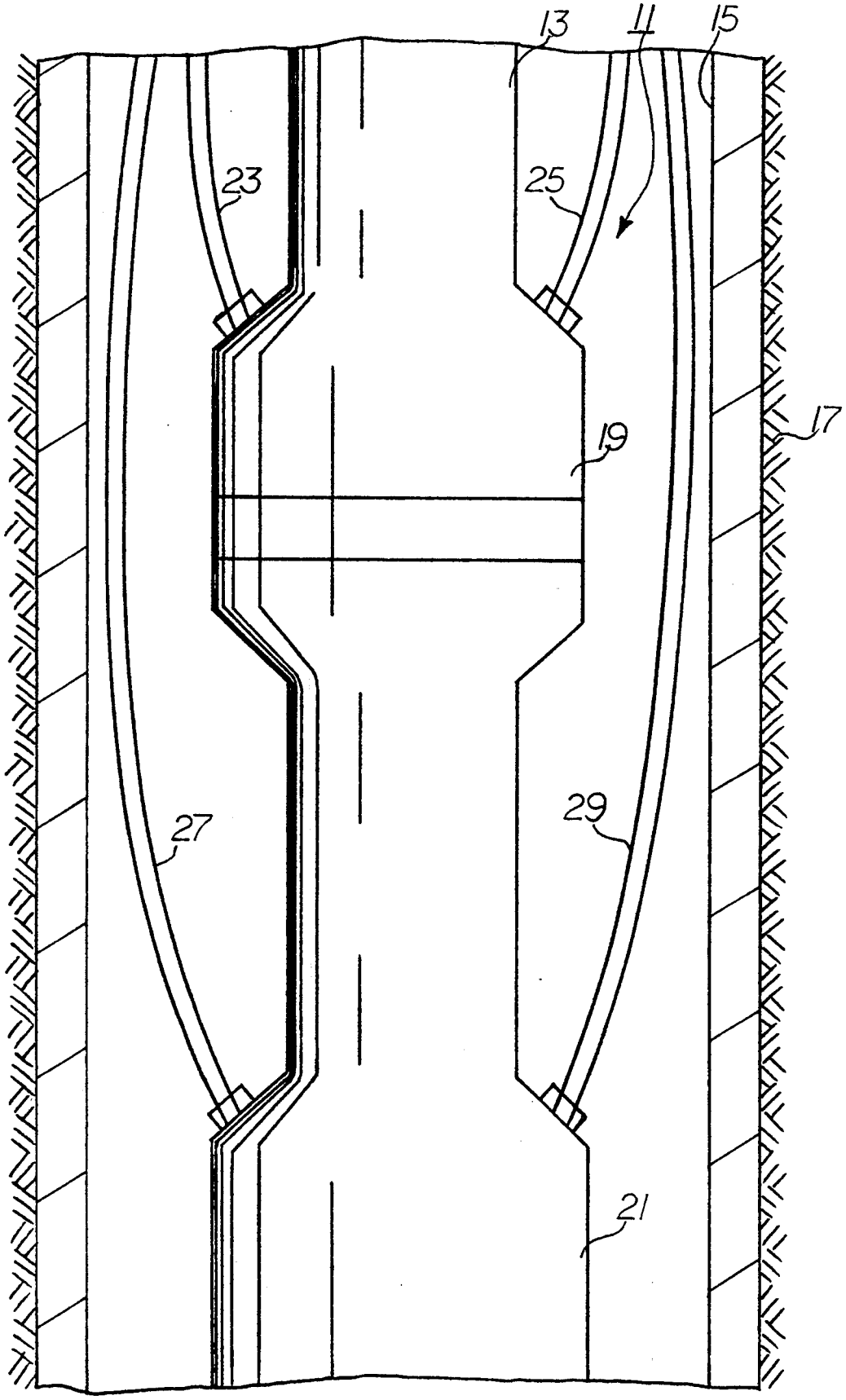
FIG. 1 is a simplified schematic view of the preferred embodiment of the tandem safety valve of the present invention.

FIG. 1 is a simplified schematic view of the preferred embodiment of tandem safety valve 11 of the present invention. Preferably, tandem safety valve 11 is threaded into a selected position in production tubing string 13 which defines a production fluid flow path. Tandem safety valve 11 is disposed concentrically within casing 15 which is provided within wellbore 17. In the preferred embodiment of the present invention, tandem safety valve 11 includes upper valve 19, and lower valve 21. Hydraulic control lines 23, 25 are provided to operate upper valve 19, while hydraulic control lines 27, 29 are provided to operate lower valve 21.

In the preferred embodiment of the present invention, one valve, such as upper valve 19, is in an active condition, which allows production fluids to flow upward through production tubing string 13, for so long as hydraulic control fluid is supplied to upper valve 19 via hydraulic control line 23, in an amount which exceeds a predetermined actuation pressure threshold. Accidental, or intentional, reduction of the pressure amplitude of the control fluid within hydraulic control line 23, will result in an automatic closure of upper valve 19, which impedes further flow of production fluids through the production fluid flow path which is defined in production tubing string 13. Since hydraulic control line 23 extends to the surface, and is accessible by an operator, upper valve 19 may be opened and closed at the operator's discretion to moderate and control the flow of production fluids through production tubing string 13. Upper valve 19, will "fail safe" to a closed position in the event that the flow of hydraulic control fluid within hydraulic control line 23 is accidentally interrupted by leakage, catastrophic failure, or decoupling of hydraulic control line 23 from upper valve 19. This is an especially useful feature in subsea oil and gas wells which are susceptible to catastrophic damage. Any interruption of the application of control fluid via hydraulic control line 23 to upper valve 19 will result in automatic closure of upper valve 19 to prevent the further flow of production fluids. In the preferred embodiment of the present invention, upper valve 19 of tandem safety valve 11 is further provided with pressure from a control fluid via hydraulic control line 25. Preferably, application of hydraulic control fluid, above a preselected pressure amplitude, will at least partially serve to switch upper valve 19 between an active condition, which is frequently also referred to as a "hot" condition, to an inactive condition which is frequently referred to as a "cold" condition, wherein the valve mechanism contained in upper valve 19 is permanently or temporarily maintained in an open condition, allowing the free flow of production fluids upward through production tubing string 13.

While in an inactive condition, upper valve 19 of tandem valve 11 would no longer require the continual application of hydraulic control fluid via hydraulic control line 23 in order to remain in the open condition.

In the preferred embodiment of the present invention, tandem safety valve 11 will include another valve, such as lower valve 21, which is maintained in a temporary and controllable inactive condition, wherein the valve mechanism of lower valve 21 is maintained in an open condition, without requiring the continual application of hydraulic control fluid to lower valve 21 via control line 27. The temporary inactive condition can also be referred to as a "cold" condition. This cold condition can be overcome by application of hydraulic control fluid in a selected pattern via hydraulic control lines 27, 29 to switch lower valve 21 from the temporarily inactive condition to an active condition.

Therefore, one of upper and lower valves 19, 21 of tandem safety valve 11 is maintained in an active condition, and is biased open by application of control fluid via one of hydraulic control lines 23, 27. Another of upper and lower valves 19, 21 of tandem safety valve 11 is maintained in a temporary inactive condition, and does not require the application of hydraulic control fluid via hydraulic control lines 23, 27 in order to maintain its open condition.

The preferred embodiment of the present invention achieves an important operating objective by providing two safety valves in tandem safety valve 11, one of which is active, and one of which is dormant and held in reserve for future use in the event that the active valve malfunctions, or in the event that remote control is lost by leakage, a defect, or damage to the hydraulic control line. Since upper and lower valves 19, 21 of tandem safety valve 11 are in series connection within production tubing string 13, either of them can be "hot" while the other is "cold". FIGS. 2 through 11 herebelow depict one of upper and lower valves 19, 21, and will be used to describe the operation of upper and lower valves 19, 21, since they are identical in construction, but operated in different operating modes in order to maintain one in a "hot" condition, and the other in a "cold" condition.

Figure 2A:
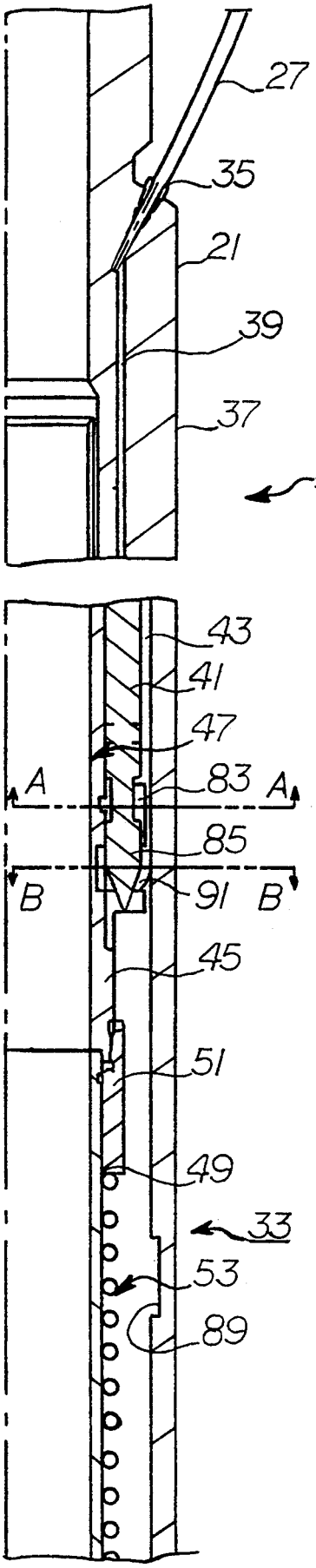
FIGS. 2(*a*) and 2(*b*) are fragmentary and one-quarter longitudinal section views of the valve of the preferred embodiment of the tandem safety valve of the present invention in a closed position, and should be viewed together, with FIG. 2(*a*) providing a view of an upper portion of the valve and FIG. 2(*b*) providing a view of a lower portion of the valve.
Figure 2B:
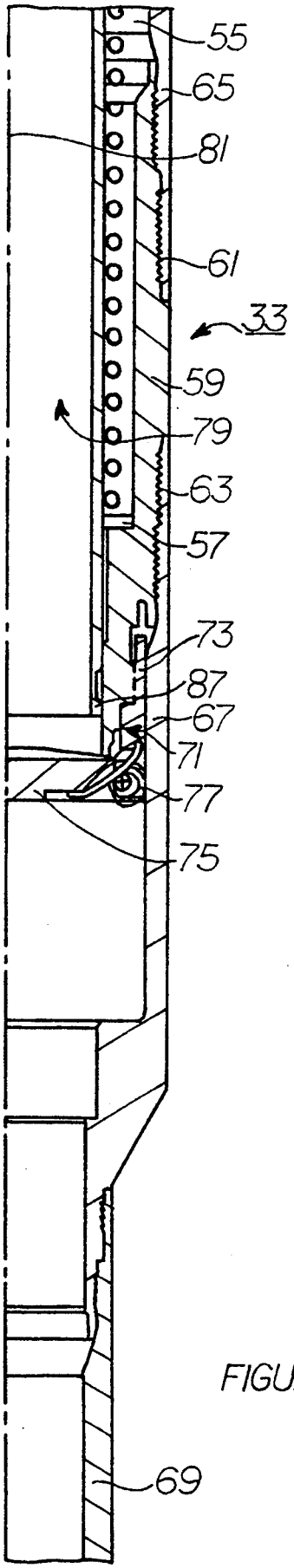

FIGS. 2(*a*) and 2(*b*) are fragmentary and one-quarter longitudinal sections views of one valve of tandem safety valve 11 of the preferred embodiment of the tandem safety valve system of the present invention, in a closed position. FIGS. 2(*a*) and 2(*b*) should be viewed together, with FIG. 2(*a*) providing a view of upper portion 31, and FIG. 2(*b*) providing a view of lower portion 33. As is shown, connector 35 is provided in valve housing 37, and is adapted for securing to hydraulic control line 27. Connector 35 communicates with fluid conduit 39 which extends longitudinally downward into valve housing 37. Fluid which is applied to valve 21 via hydraulic control line 27 will act upon normal-operation actuator 41 which is disposed in actuator annulus 43 between valve housing 37 and upper portion 45 of flow tube 47. Upper portion 45 and lower portion 49 of flow tube 47 are coupled together at spring cam 51 which selectively acts upon closure-biasing spring 53, which is maintained in spring cavity 55. Closure-biasing spring 53 is buttressed at its lowermost end at shoulder 57 which is defined in lower collar 59 which includes upper and lower external threads 61, 63 which serve to secure lower collar 59 to upper and lower mandrels 65, 67. Lower mandrel 67 is threaded at its lowermost end for coupling with production tubing string 69. Flapper valve 71 is secured between lower collar 59 and lower mandrel and includes stationary portion 73, and movable portion 75, with biasing member urging the disc-shaped movable portion 75 into fluid-blocking relation to fluid flow path 79. More specifically, biasing member 77 operates to urge movable portion 75 into a position which is substantially normal to the central longitudinal axis 81 of valve 21. Flow tube 47 includes latch member 83 which selectively and releasably engages enlarged head 85 of normal-operation actuator 41. While actuator 41 and latch member 83 are engaged, the application of hydraulic fluid via hydraulic control line 27 to valve 21 will operate to stroke normal-operation actuator 41 longitudinally downward relative to valve housing 37, causing downward displacement of flow tube 47, which causes lowermost end 87 of flow tube 47 to engage movable portion 75 of flapper valve 71, working against biasing member 77, and causing movable portion 75 to rotate through a ninety degree arc and out of blocking relation to fluid flow path 79 within valve 21. This causes valve 21 to move from the closed position which is depicted in FIGS. 2(*a*) and 2(*b*) to the open position which is depicted in FIGS. 3(*a*) and 3(*b*).

Figure 3B:
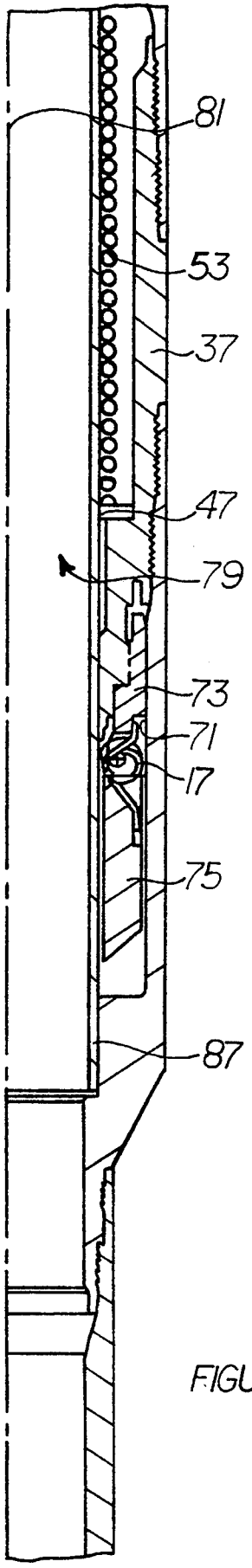
FIGS. 3(*a*) and 3(*b*) are fragmentary and one-quarter longitudinal section views of one valve of the preferred embodiment of the tandem safety valve of the present invention in an open position, and should be viewed together, with FIG. 3(*a*) providing a view of an upper portion of the valve and FIG. 3(*b*) providing a view of a lower portion of the valve.
Figure 3A:
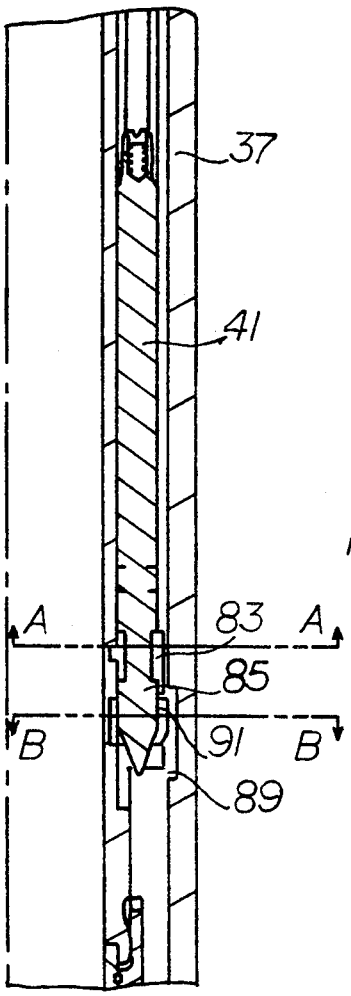

As is shown in FIGS. 3(*a*) and 3(*b*), normal-operation actuator 41 is stroked longitudinally downward relative to valve housing 37, and is maintaining engagement with latch member 83. As will be discussed in further detail herebelow, application of hydraulic control fluid to hydraulic control line 29 (which is not depicted in FIGS. 3(*a*) and 3(*b*) can cause enlarged head 85 of normal-operation actuator 41 to become disengaged from latch member 83, while latch member 83 is longitudinally aligned with locking groove 89. As will be noted in the view of FIG. 3(*a*), latch member 83 includes locking dog 91, which is adapted for selectively engaging locking groove 89, as will be discussed in further detail herebelow. As shown in FIG. 3(*b*), flow tube 47 is stroked longitudinally downward relative to valve housing 37, causing lowermost end 87 of flow tube 47 to act upon movable portion 75 of flapper valve 71, causing it to move into axial alignment with stationary portion 73, and out of fluid blocking relation to fluid flow path 79. Accordingly, the view of FIGS. 3(*a*) and 3(*b*) represent the valve 21 in the present invention in an open condition.

Figure 4A:
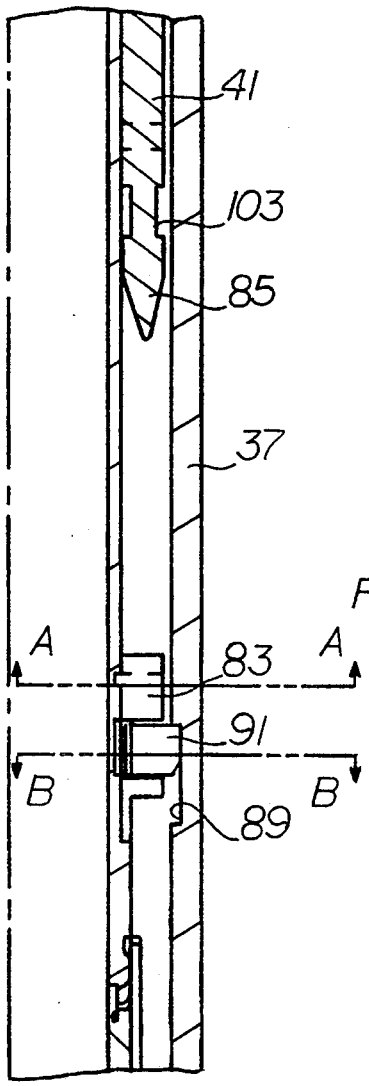
FIGS. 4(*a*) and 4(*b*) are fragmentary and longitudinal section views of one valve of the preferred embodiment of the tandem safety valve of the present invention in a locked open position, and should be viewed together, with FIG. 4(*a*) providing a view of an upper portion of the valve and FIG. 4(*b*) providing a view of a lower portion of the valve.
Figure 4B:
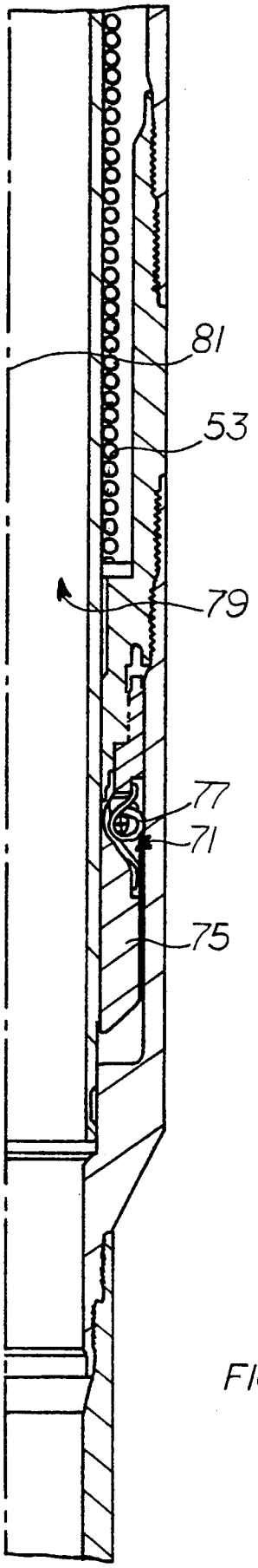

FIGS. 4(*a*) and 4(*b*) depict valve 21 of the present invention in a locked-open condition, wherein enlarged head 85 of normal-operation actuator 41 has disengaged from latch member 83. Furthermore, locking dog 91 has been urged radially outward into locking engagement with locking groove 89. In the locked-open condition of FIGS. 4(*a*) and 4(*b*), closure-biasing spring 53 remains compressed, while movable portion 75 of flapper valve 71 remains in a non-obstructing position relative to fluid flow path 79.

FIGS. 5(*a*) through 5(*f*) provide fragmentary cross-section views of valve 21 of the present invention as seen along section lines which are provided in FIGS. 2(*a*), 3(*a*) and 4(*a*), and will be used to describe the operation of latch member 83. FIGS. 5(*a*) and (*b*) are section views as seen along section lines A—A and B—B respectively. First with reference to FIG. 5(*a*), rotator spring 93 operates on latch member 83 by pulling it clockwise to cause opening 95 in plate 97 to rotate slightly in the clockwise direction relative to normal-operation actuator 41. This causes opening 95 of plate 97 to become misaligned with enlarged head 85 of normal-operation actuator 41, and specifically causes opening 95 to engage enlarged head 85 of normal-operation actuator 41 at latch groove 103 (which is depicted in FIG. 4(*a*), but not in FIG. 5(*a*)). Alignment pin 99 is provided, and is stationary relative to plate 97. Alignment pin 99 rides in slot 101. Alignment pin 99 and slot 101 cooperate to ensure that plate 97 is limited to rotational movement relative to both alignment pin 99 and normal-operation actuator 41, and is not susceptible to radial movement. FIG. 5(*a*) also depicts locking actuator 105 which is similar to normal-operation actuator 41, but is instead stroked longitudinally downward (that is, upward from the plane of the section view of FIG. 5(*a*), relative to valve housing 37. Opening 107 is provided in plate 97, and is adapted for receiving locking actuator 105. In the view of FIG. 5(*a*), locking actuator 105 has not yet engaged opening 107. Since rotator spring 93 operates to bias plate 97 in a clockwise direction, opening 107 is slightly misaligned relative to locking actuator 105. In the configuration shown in FIG. 5(*a*), plate 97 is securely engaged about enlarged head 85 of normal-operation actuator 41 due to the misalignment which is induced by rotator spring 93. In operation, when locking actuator 105 extends further downward, it will engage a portion of opening 107, and urge plate 97 in a counter-clockwise direction in opposition to the bias of rotator spring 93.

FIG. 5(*c*) provides a view of latch member 83 with valve 21 in an open position. However, the relative positions of plate 97, normal-operation actuator 41, and locking actuator 105 are substantially unchanged from the view of FIG. 5(*a*).

FIG. 5(*e*) provides a fragmentary cross-section view as seen along section line A—A of FIG. 4(*a*), with valve 21 in a locked-open condition. As is shown in both FIG. 5(*e*) and FIG. 4(*a*), normal-operation actuator 41 is disengaged from latch member 83, and locking dog 91 is maintained in its position relative to valve housing 37. However, normal-operation actuator 41 and locking actuator 105 have been retracted relative to housing 37 and latch member 83 so openings 95 and 105 are displayed in the view of FIG. 5(*e*) in substantially unoccluded view.

With reference now to FIG. 5(*b*), there is depicted the fragmentary cross-section view as seen along section line B—B of FIG. 2(*a*). As is shown, locking dog 91 is disposed in cavity 113 of latch member 83, and includes arcuate outer surface 109 which conforms to the shape of bore 115 of valve housing 37, and an inner surface 111 which is contoured to conform in shape to cavity 113. Dog springs 117, 119 are provided between cavity 113 and inner surface 111 of locking dog 91. Dog springs 117, 119 operate to urge locking dog 91 radially outward toward bore 115 of valve housing 37. In the view of FIG. 5(*b*), the position of locking groove 89 relative to bore 115 of valve housing 37 is represented in phantom view. Also, in the view of FIG. 5(*b*), normal-operation actuator 41 is shown extending through locking dog 91. In operation, normal-operation actuator 41 operates in opposition to dog springs 117, 119, and prevents the radially-outward displacement of locking dog 91 relative to latch member 83 while normal-operation actuator 41 is engaging locking dog 91 at bore 121. Also, in the view of FIG. 5(*b*), opening 107 and locking actuator 105 are depicted.

With reference now to FIG. 5(*d*), there is depicted a fragmentary cross-section view of valve 21 as seen along section line B—B of FIG. 3(*a*), with valve 21 in an open condition, and with locking dog 91 in longitudinal alignment with locking groove 89. In this position, it is normal-operation actuator 41 which prevents dog springs 117, 119 from urging locking dog 91 radially outward into contact with locking groove 89. In FIG. 5(*f*), there is depicted a fragmentary cross-section view of valve 21, as seen along section line B—B of FIG. 4(*a*), with valve 21 in a locked-open condition, and with normal-operation actuator 41 retracted from locking dog 91, allowing dog springs 117, 119 to bias locking dog 91 radially outward from cavity 113, causing outer surface 109 of locking dog 91 to engage bore 115 at locking groove 89.

Figure 6B:
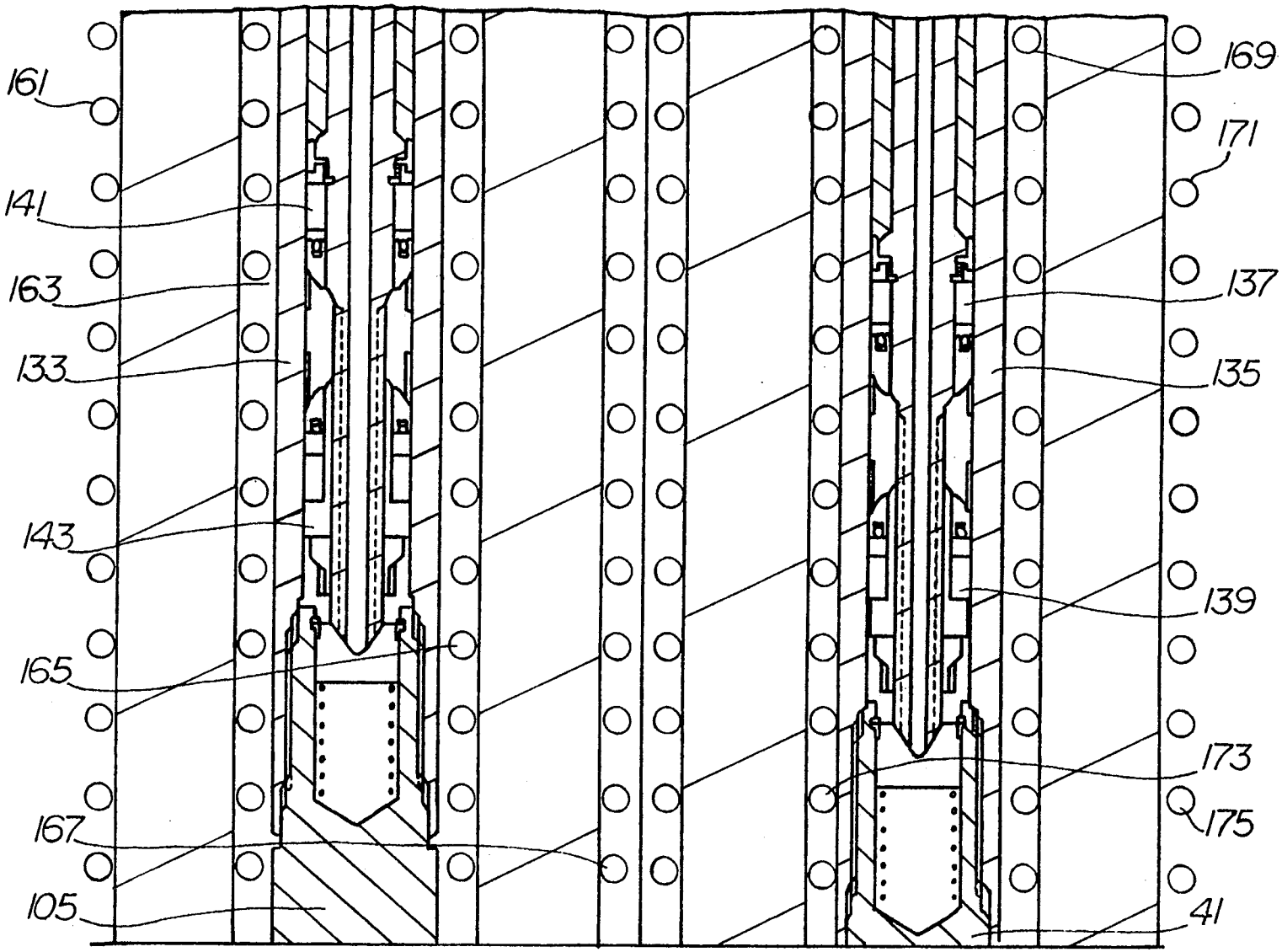
Figure 6A:
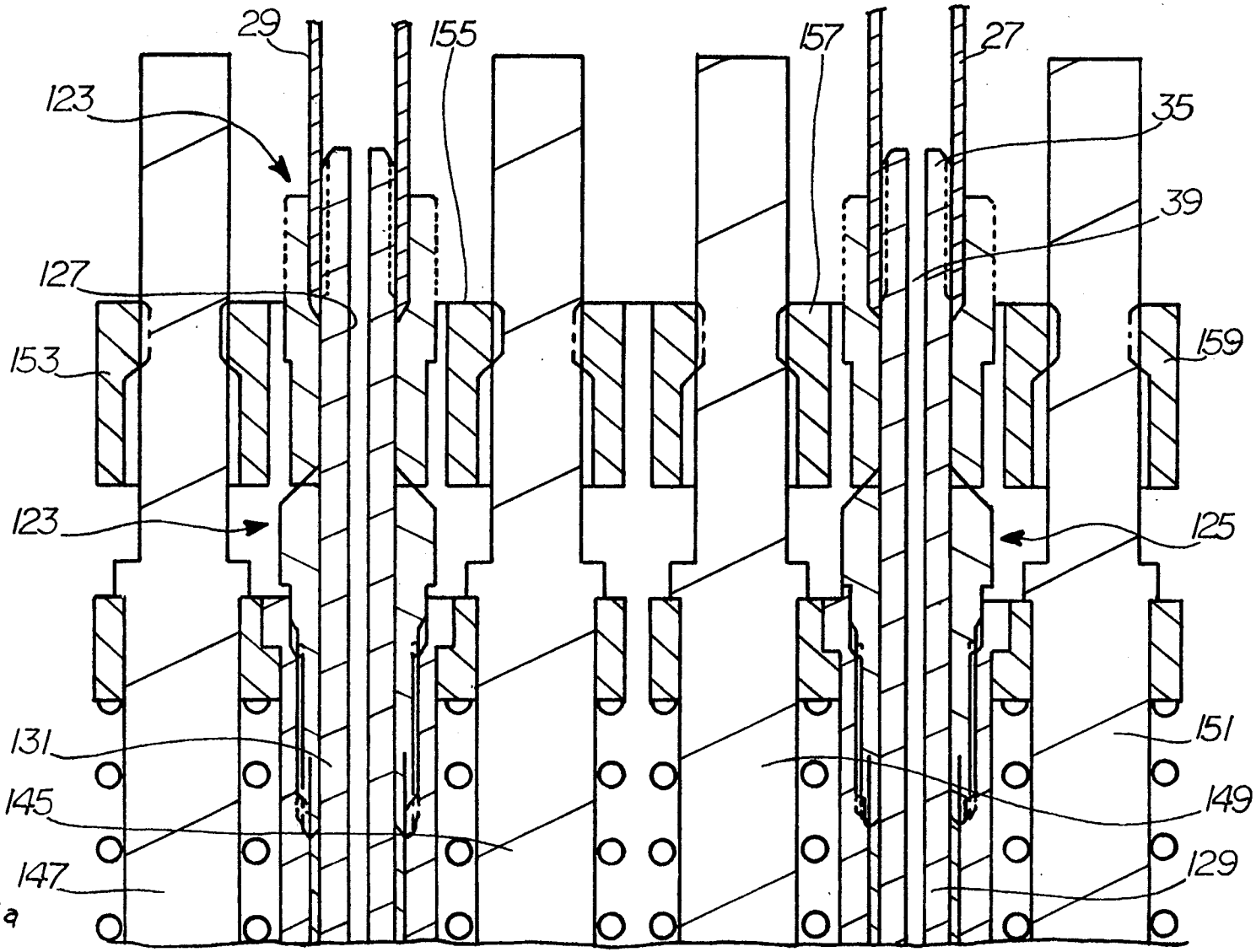

The relationship between normal-operation actuator 41 and locking actuator 105 is best depicted with reference to FIGS. 6(*a*) through 11, which present fragmentary longitudinal section views of valve 21 of the preferred embodiment of the tandem safety valve 11 of the present invention, which have been "rolled-out" to reveal the spatial and functional relationships between the normal-operation actuator 41 and locking actuator 105. In the preferred embodiment of the present invention, normal-operation actuator 41 includes piston and cylinder assembly 125 which cooperate to stroke normal-operation actuator 41 downward. Also, locking actuator 105 includes piston and cylinder assembly 123 which cooperate to allow downward extension of locking actuator 105. Piston and cylinder assembly 125 is actuated in response to hydraulic control fluid which is supplied via hydraulic control line 27. Piston and cylinder assembly 123 of locking actuator 105 is operable in response to hydraulic control fluid which is supplied to nozzle 123 via hydraulic control line 29. Hydraulic fluid is selectively directed downward from hydraulic control lines 27, 29 into fluid conduits 39, 127 of piston members 129, 131, respectively. In the preferred embodiment of the present invention, piston members 129, 131 are the stationary components of piston and cylinder assemblies 123, 125. Cylinders 133, 135 are stroked downward relative to piston members 129, 131 in response to the application of hydraulic fluid from hydraulic control lines 27, 29. Wiper seals 137, 139, 141, and 143 are provided in piston and cylinder assemblies 123, 125 to provide a dynamic seal between the piston members 129, 131 and cylinders 133, 135. Guide rails 145, 147, 149, and 151 are provided on both sides of the piston and cylinder assemblies 123, 125 of normal-operation actuator 41 and locking actuator 105. Guide rails 145, 147, 149, 151 are held in position at the their uppermost end by lock nuts 153, 155, 157, 159.

Closure springs 161, 163, 165, 167, 169, 171, 173, and 175 are provided to bias normal-operation actuator 41 and locking actuator 105 upward relative to valve housing 37. The use of springs is conventional in safety valves to ensure that the valves fail-safe to a closed position to prevent unregulated flow of wellbore fluids from the production tubing string. The fail safe feature is especially important in subsea wells, since storms and high seas can damage the well heads, and result in substantial environmental pollution. Safety valves ensure that such pollution is minimized.

Figure 7:
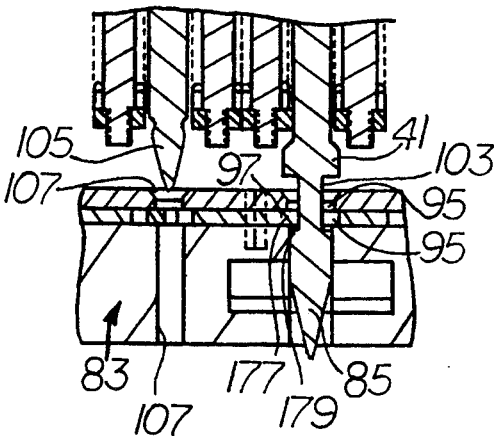
FIGS. 6 through 10 are fragmentary longitudinal section views of one valve of the preferred embodiment of the tandem safety valve of the present invention, which has been "rolled-out" to reveal the spatial and functional relationships between a normal-operation actuator and a locking actuator.

FIG. 7 is a view of the lowermost portion of normal-operation actuator 41 and locking actuator 105 while valve 21 is in a closed condition. FIGS. 6 and 7 may be read together, and notwithstanding the fragmentary nature of these figures, they will provide an overview of the functional and spatial relationship between the components of the preferred valve 21 of the present invention while in a closed condition. As shown in FIG. 7, opening 95 extends through latch member 83, as well as plate 97. Since plate 97 is offset with respect to latch member 83, edge 177 engages normal-operation actuator 41 at latch groove 103, and provides a buttress for external shoulder 179 to prevent normal-operation actuator 41 from disengaging from latch member 83. As is also shown in FIG. 7, opening 107 is formed in part in latch member 83, and in part in plate 97. Since plate 97 is biased by rotor spring 93 (which is not depicted in this figure) opening 107 in plate 97 is offset with respect to latch member 83.

Figure 8:
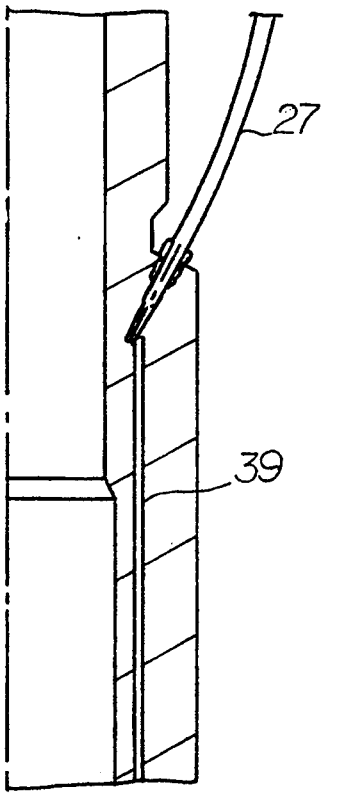
Figure 8:
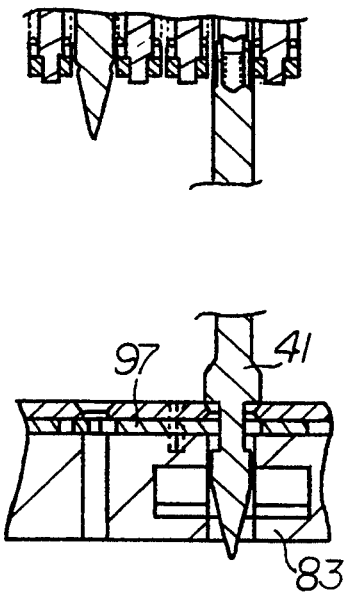
Figure 10:
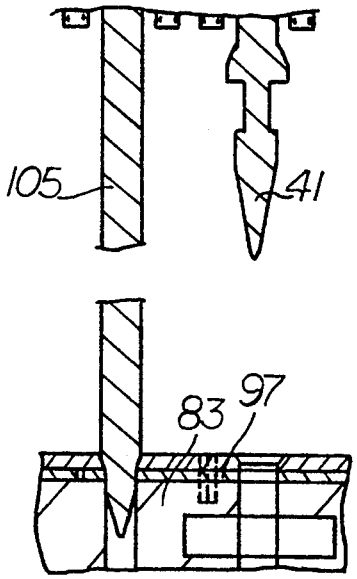
Figure 5A:
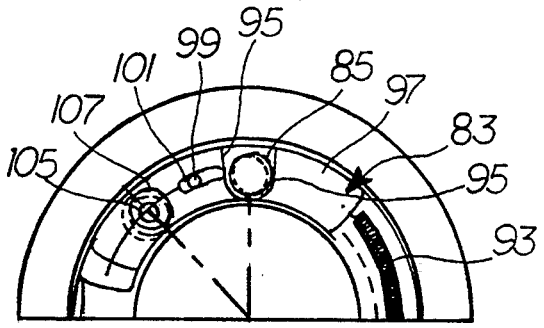
FIGS. 5(*a*) through 5(*f*) provide fragmentary cross-section views as seen along various section lines of FIGS. 2(*a*), 3(*a*), and 4(*b*)
Figure 5B:
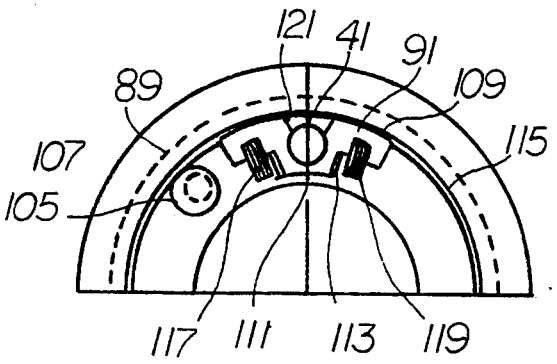
Figure 5C:
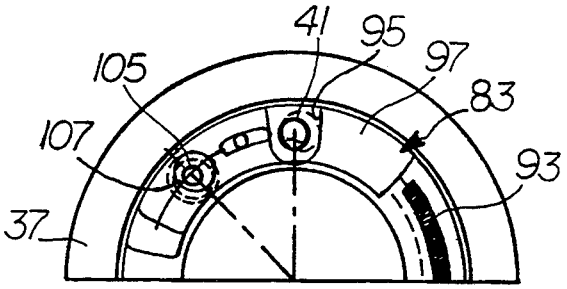
Figure 5D:
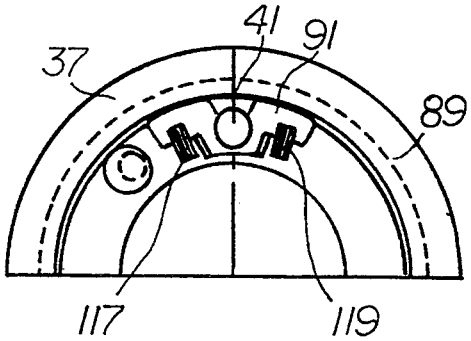
Figure 5E:
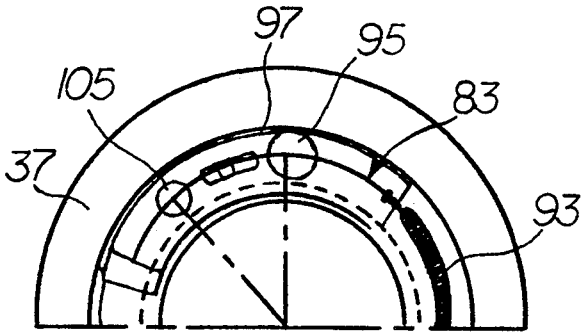
Figure 9:
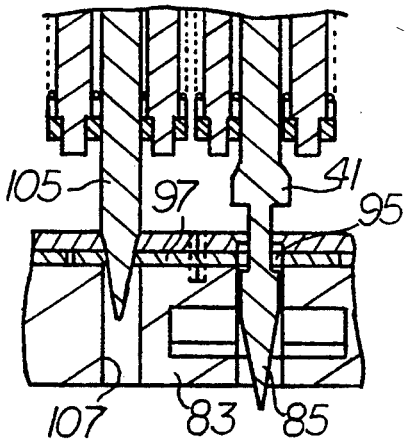
Figure 5F:
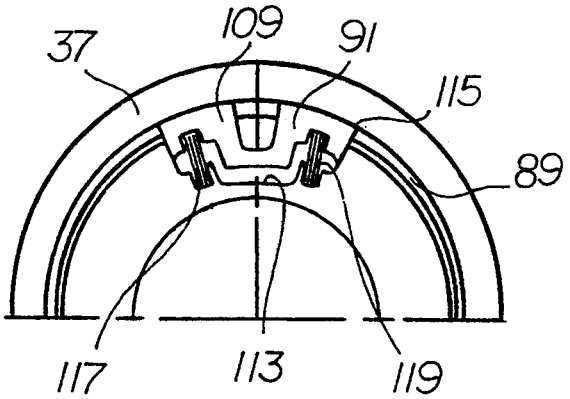

FIG. 8 is a fragmentary rolled-out view of valve 21 of the present invention with normal-operation actuator 41 extended downward, while maintaining a locked engagement with latch member 83. With reference to FIGS. 3(*a*) and (*b*), downward extension of normal-actuator 41 operates to compress closure-biasing spring 53, and move flapper valve 71 to an open condition to allow wellbore fluids to flow upward through the production tubing string 13. It is this opening operation which is graphically depicted in the view of FIG. 8. Of course, normal-operation actuator 41 may be moved upward relative to valve housing 37 by interrupting the application of high pressure hydraulic control fluid to valve 21 via hydraulic control line 27. In the view of FIG. 9, normal-operation actuator 41 has been returned upward, and valve 21 is in a closed position. Application of hydraulic fluid to valve 21 via hydraulic control line 29 (of FIG. 1) will cause locking actuator 105 to extend downward relative to valve housing 37. The situation is shown in the view of FIG. 9. The extension of locking actuator 105 into opening 107 applies force to plate 97 which works in opposition to rotor spring 93 (which is not shown in FIG. 9), and realignment of plate 97 to allow enlarged head 85 of normal-operation actuator 41 to be removed from latch member 83. In the view of FIG. 10, locking actuator 105 is fully extended, which urges latch member 83 downward relative to valve housing 37. In contrast, normal-operation actuator remains in a stationary position relative to valve housing 37. As shown best in FIG. 4(*a*), latch member 83 is maintained in a fixed position relative to valve housing 37 by operation of locking dog 91, as well was discussed above in connection with FIG. 5.

Figure 11:
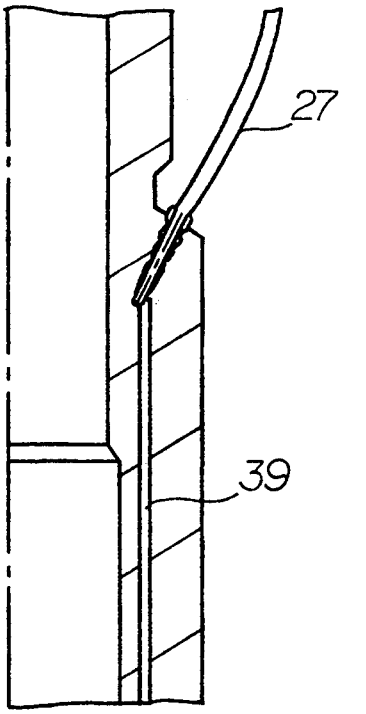
FIG. 11 is a view of the locking actuator in a retracted position.
Figure 11:
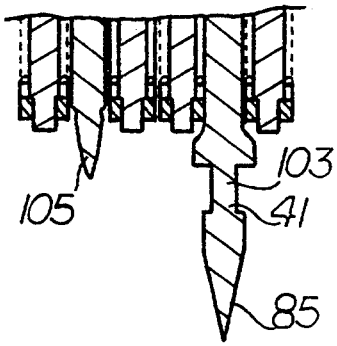

With reference now to FIG. 11, with locking dog 91 maintaining latch member 83 in a fixed position relative to valve housing 37, locking actuator 105 may be retracted upward relative to valve housing 37. To override the locked-open condition, normal operation actuator 41 is extended. The tapered outer surface of enlarged head 85 of normal-operation actuator 41 operates to allow enlarged head 85 to wedge its way into latch member 83 by overcoming the spring force. Once enlarged head 85 passes into latch member 83, plate 97 will engage latch groove 103 of normal-operation actuator 41. Simultaneously, locking dog 91 will be urged out of locking groove 89. Essentially, normal-operation actuator 41 wedges its way into latch member 83, and works in opposition to both rotor spring 93 and dog springs 117, 119. With normal-operation actuator 41 securely engaging latch member 83, normal-operation actuator 41 may be retracted to move latch member 83 upward, and allow closure of flapper valve 91 to obstruct the flow of fluid within production tubing 13.

While the invention has been shown in only one of its forms, it is not thus limited but is susceptible to various changes and modifications without departing from the spirit thereof.

What is claimed is:

1. A tandem safety valve for use in a tubing string in a wellbore to selectively permit fluid flow through the tubing string, the tandem safety valve comprising:

a housing for connection into the tubing string, the housing having a fluid conduit therethrough in fluid flow communication with the tubing string; and a first valve and a second valve disposed in series in the housing to selectively permit fluid flow through the fluid conduit of the housing, each of the first valve and the second valve including:

a flow tube disposed in the housing and selectively mechanically couplable to a closure member to selectively open and close the closure member, the flow tube including a locking dog for selective engagement with the housing to maintain the closure member in a selectable locked-open condition;

a flow tube biasing member coupled between the housing and the flow tube to urge the flow tube away from the closure member and into a fail-safe position;

a normal-operation actuator including a normal-operation cylinder in fluid flow communication with a normal-operation fluid pressure source to urge the normal-operation actuator into and out of engagement with the flow tube for selective opening and closing of the closure member;

a latch coupled to the flow tube to selectively engage and couple the normal-operation actuator to the flow tube; and a locking actuator including a locking actuator cylinder in fluid flow communication with a locking fluid pressure source to selectively uncouple the normal-operation actuator from the latch.

2. The tandem safety valve according to claim 1 wherein the latch, the flow tube biasing member, the normal-operation actuator, and the locking actuator are disposed in an annular space between the flow tube and the housing and are protected from fluid flow through the safety valve.

3. In a tandem safety valve for connection into a tubing string for use in a wellbore, the tandem safety valve having a pair of valves connected in series in a housing, each of the valves including a flow tube, biased into a fail-safe normally closed position, the flow tube for selectively opening and closing each of the pair of valves against fluid flow in the tubing string, the housing including an hydraulic actuation cylinder in fluid flow communication with a normal-operation fluid pressure source, and a locking hydraulic actuation cylinder in fluid flow communication with a locking fluid pressure source, an apparatus for selectively locking open, and selectively opening and closing, each of the pair of valves of the tandem safety valve, the apparatus comprising:

a normal-operation actuator means coupled to the normal-operation hydraulic cylinder to selectively and releasably engage the flow tube and valve for selectively opening and closing each valve;

latch means for selectively and releasably securing the normal-operation actuator to the flow tube;

locking dog means for selectively and releasably securing the flow tube to the housing wherein each valve is selectively maintained in a locked-open condition; and locking actuator means coupled to the locking hydraulic actuation cylinder to selectively release the normal-operation actuator means from engagement with the latch means and the locking dog means, wherein the locking dog means can engage the housing to secure the flow tube to the housing in a locked-open position; and wherein each of the pair of valves is operable in a plurality of conditions, the plurality of conditions including:

a normal-operation condition in which the normal-operation actuator means is engaged with the latch means, and normal-operation actuator means and the flow tube are movable to open and close the valve member against fluid flow through the tandem safety valve;

a locked-open condition in which the normal-operation actuator means is disengaged from the latch means and the locking dog means is engaged with the housing to maintain the flow tube stationary relative to the housing, wherein the valve is locked open to fluid flow through the tandem safety valve; and a locking condition in which the locking actuator means is engaged with the latch means to release the normal-operation actuator means and urge the flow tube into the locked-open condition; and a fail-safe closed condition in which the normal-operation actuator means and the locking actuator means are disengaged from the latch means and the valve is maintained in a closed position to block fluid flow through the tandem safety valve.

4. The tandem safety valve according to claim 3 wherein the latch means, the locking dog means, the normal-operation actuator means, and the locking actuator means are disposed in an annular space between the flow tube and the housing and are protected from fluid flow through time safety valve.

5. The tandem safety valve according to claim 3 wherein the locked-open condition is maintained without fluid pressure from the locking fluid pressure source and the normal-operation fluid pressure source.

6. A safety valve for use in a wellbore to selectively permit fluid flow through a tubing string in the wellbore, the safety valve comprising:

a housing;

a valve member disposed in the housing to selectively block fluid flow through the safety valve;

a flow tube disposed in the housing and selectively engageable with the valve member;

a latch member secured to the flow tube to selectively and releasably engage a normal-operation actuator;

a locking dog coupled to the latch member to selectively maintain the flow tube stationary relative to the housing, wherein the valve member is maintained in an open position to permit fluid flow through the safety valve; and a locking actuator to selectively engage the latch member to disengage the normal-operation actuator from the latch member.

7. The safety valve according to claim 6 further including a flow tube biasing member disposed between the flow tube and the housing to urge the flow tube into a fail-safe position wherein the valve member is maintained in a closed position.

8. The safety valve according to claim 6 being operable in a plurality of conditions, the plurality of conditions including:

a normal-operation condition in which the normal-operation actuator is engaged with the latch member, and normal-operation actuator and flow tube are selectively movable to open and close valve member against fluid flow through the safety valve;

a locked-open condition in which the normal-operation actuator is disengaged from the latch member and the locking dog is engaged with the housing to maintain the flow tube stationary relative to the housing, wherein the valve member is locked open to permit fluid flow through the safety valve;

a locking condition in which the locking actuator engages the latch member to release the normal-operation actuator and urge the flow tube into the locked-open condition; and a fail-safe closed condition in which the normal-operation actuator and the locking actuator are disengaged from the latch member and the valve member is maintained in a closed position to block fluid flow through the safety valve.

9. The safety valve according to claim 6 wherein the normal-operation actuator is in fluid flow communication with and is responsive to fluid pressure from a normal-operation fluid pressure source, and wherein the locking actuator is in fluid flow communication with and is responsive to fluid pressure from a locking fluid pressure source.

10. The safety valve according to claim 6 wherein the latch member, the locking dog, the normal-operation actuator, and the locking actuator are disposed in an annular space between the flow tube and the housing and are protected from fluid flow through the safety valve.

11. The safety valve according to claim 6 wherein the locking dog is prevented from maintaining the valve member in an open position while the normal-operation actuator is engaged with the latch member.

12. A safety valve for use in a wellbore to selectively permit fluid flow through a tubing string in the wellbore, the safety valve comprising:

a housing;

a valve member disposed in the housing to selectively block fluid flow through the safety valve;

a flow tube disposed in the housing and selectively engageable with the valve member;

a latch member secured to the flow tube to selectively and releasably engage a normal-operation actuator, the normal operation actuator in communication with and responsive to fluid pressure from a normal-operation fluid pressure source;

a cam member coupled to the latch member to selectively maintain the flow tube stationary relative to the housing, wherein the valve member is maintained in an open position to permit fluid flow through the safety valve; and a locking actuator to selectively engage the latch member to disengage the normal-operation actuator from the latch member, the locking actuator in communication with and responsive to fluid pressure from a locking fluid pressure source.

13. The safety valve according to claim 12 wherein the latch member, the cam member, the normal-operation actuator, and the locking actuator are disposed in an annular space between the flow tube and the housing and are protected from fluid flow through the safety valve.

14. The safety valve according to claim 12 wherein the cam member is prevented from maintaining the valve member in an open position while the normal-operation actuator is engaged with the latch member.

15. A method of valving to control fluid flow in a tubing string in a wellbore, the tubing string including a tandem safety valve, the method comprising the steps of:

assembling at the surface a tubing string including a pair of safety valves, including an uppermost safety valve and a lowermost safety valve, connected in series in the tubing string, the uppermost and lowermost safety valves including:

a housing;

a valve member disposed in the housing to selectively block fluid flow through the safety valve;

a flow tube disposed in the housing and selectively engageable with the valve member;

a latch member secured to time flow tube to selectively and releasably engage a normal-operation actuator;

a locking dog coupled to the latch member to selectively engage the housing to maintain the flow tube stationary relative to the housing, wherein the valve member is maintained in a locked-open position to permit fluid flow through the safety valve; and a locking actuator to selectively engage the latch member to disengage the normal-operation actuator from the latch member;

running the tubing string including the pair of safety valves to a selected depth in the wellbore;

locking open the lowermost safety valve by actuating the locking actuator of a lowermost safety valve to engage the latch member and to urge the flow tube into a locked-open condition wherein the flow tube is releasably secured to the housing by the locking dog wherein the valve member of the lowermost safety valve permits fluid flow through the lowermost safety valves;

normally operating an uppermost of the pair of safety valves by actuating the normal-operation actuator of the uppermost pair of the valves to engage the latch member and locking dog to selectively open and close the valve member of the uppermost of the pair of the valves to selectively permit fluid flow through the pair of safety valves.

16. The method of claim 15 further including the step of closing the uppermost safety valve by actuating the locking actuator of the uppermost valve to engage the latch member and release the normal-operation actuator from engagement with the latch member, wherein a flow tube biasing member urges the flow tube to a fail-safe position wherein the valve member obstructs fluid flow through the pair of safety valves in an emergency condition in which fluid flow through the pair of safety valves must be obstructed.

17. The method according to claim 15 further comprising the steps of unlocking the lowermost safety valve by actuating the normal-operation actuator to engage the latch member and release the locking dog from engagement with the housing to permit normal operation of the lowermost safety valve in a condition in which the uppermost safety valve is inoperable.

18. A safety valve for use in a wellbore to selectively permit fluid flow through a tubing string in the wellbore, the safety valve comprising:

a housing for connection into the tubing string;

a flapper valve secured to the housing for movement between an open and a closed position;

a tube member longitudinally movable in the housing to move the flapper valve from the open to the closed position;

a normal-operation cylinder and piston, the normal-operation piston being stationary relative to the housing and the normal-operation cylinder being movable relative to the normal-operation piston responsive to fluid pressure from a normal-operation fluid pressure source;

a locking cylinder and piston, the locking piston being stationary relative to the housing and the locking cylinder being movable relative to the locking piston responsive to fluid pressure from a locking fluid pressure source;

a normal-operation actuator coupled to the normal-operation cylinder and piston;

a latch coupled to the tube member to selectively and releasably engage the normal-operation actuator;

a locking member coupled to the latch to selectively maintain the tube member stationary relative to the housing, wherein the flapper is maintained in the open position without fluid pressure from the normal-operation and locking fluid pressure sources; and a locking actuator coupled to the locking cylinder and piston to selectively engage the latch and disengage the normal-operation actuator from the latch.

19. The safety valve according to claim 18 wherein the tube member is movable responsive to movement of one of the normal-operation and locking actuators.

20. The safety valve according to claim 18 wherein the normal-operation cylinder and piston, the normal-operation actuator, the locking cylinder and piston, and the locking actuator are disposed in an annulus defined between the tube member and the housing, away from fluid flow through the safety valve.

21. The safety valve according to claim 18 further including a biasing member coupled between the housing and the tube member to urge the tube member to a fail-safe condition, wherein the flapper is in the closed position.

22. A safety valve for use in a wellbore to selectively permit fluid flow through a tubing string in the wellbore, the safety valve comprising:

a housing for connection into the tubing string;

a flapper valve secured to the housing for movement between an open and a closed position;

a tube member longitudinally movable in the housing to move the flapper valve from the open to the closed position;

a biasing member coupled between the housing and the tube member to urge the tube member to a fail-safe condition, wherein the flapper is in the closed position;

a normal-operation cylinder and piston, the normal-operation piston being stationary relative to the housing and the normal-operation cylinder being movable relative to the housing responsive to fluid pressure from a normal-operation fluid pressure source;

a locking cylinder and piston, the locking piston being stationary relative to the housing and the locking cylinder being movable relative to the housing responsive to fluid pressure from a locking fluid pressure source;

a normal-operation actuator coupled to the normal-operation cylinder and piston, the normal-operation actuator being selectively engageable with the tube member to move the tube member and flapper valve between the open and closed positions; and a locking actuator coupled to the locking cylinder and piston to selectively engage the tube member to disengage the normal-operation actuator from the tube member and move the tube member to a releasably locked position in which the flapper valve is in the open position and the tube member is releasably maintained stationary relative to the housing without fluid pressure from the locking and normal-operation fluid pressure sources, the tube member being released from the releasably locked position by engagement of the normal-operation actuator with the tube member.

23. The safety valve according to claim 22 wherein the normal-operation cylinder and piston, the normal-operation actuator, the locking cylinder and piston, and the locking actuator are disposed in an annulus defined between the tube member and the housing, isolated from fluid flow through the safety valve.

24. A safety valve for use in a wellbore to control fluid flow in a tubing string in the wellbore, the safety valve comprising:

a housing for connection in the tubing string;

a valve disposed in the housing and movable between an open position and a closed position;

a tube longitudinally movable in the housing to move the valve between the open and closed positions, the tube including a latch and locking member, the locking member for selective engagement with the housing;

an annulus defined between the housing and the flow tube;

a normal-operation actuator disposed in the annulus for selective and releasable engagement with the latch, wherein the normal-operation actuator and the tube selectively move the valve between the open and closed positions;

a locking actuator disposed in the annulus for selective engagement with the latch, wherein the valve is moved to the open position and the flow tube is releasably secured against movement relative to the housing by the locking member.

25. The safety valve according to claim 24 further comprising a biasing member disposed in the annulus to urge the tube to a fail-safe position, wherein the valve is maintained in the closed position.

26. The safety valve according to claim 24 wherein the normal-operation and locking actuators each include:

a cylinder for movement relative to the housing responsive to fluid pressure from a fluid pressure source; and a piston secured to the housing, the piston being stationary relative to the cylinder.

27. A tandem safety valve for use in a wellbore to control fluid flow in a tubing string in the wellbore, the tandem safety valve including:

a pair of independently actuable safety valves connected in series in the tubing string, each safety valve including:

a housing for connection into the tubing string;

a flapper valve secured to the housing for movement between an open and a closed position;

a tube member longitudinally movable in the housing to move the flapper valve from the open to the closed position;

a normal-operation cylinder and piston, the normal-operation piston being stationary relative to the housing and the normal-operation cylinder being movable relative to the housing responsive to fluid pressure from a normal-operation fluid pressure source;

a locking cylinder and piston, the locking piston being stationary relative to the housing and the locking cylinder being movable relative to the housing responsive to fluid pressure from a locking fluid pressure source;

a normal-operation actuator coupled to the normal-operation cylinder and piston;

a latch coupled to the tube member to selectively and releasably engage the normal-operation actuator;

a locking member coupled to the latch to selectively maintain the tube member stationary relative to the housing, wherein the flapper is maintained in the open position without fluid pressure from the normal-operation and locking fluid pressure sources; and a locking actuator coupled to the locking cylinder and piston to selectively engage the latch and disengage the normal-operation actuator from the latch.

28. The safety valve according to claim 27 wherein the tube member is movable responsive to movement of one of the normal-operation and locking actuators.

29. The safety valve according to claim 27 wherein the normal-operation cylinder and piston, the normal-operation actuator, the locking cylinder and piston, and the locking actuator are disposed in an annulus defined between the tube member and the housing, away from fluid flow through the safety valve.

30. The safety valve according to claim 27 further including a biasing member coupled between the housing and the tube member to urge the tube member to a fail-safe condition, wherein the flapper is in the closed position.

31. A safety valve for use in a wellbore to selectively permit fluid flow through a tubing string in the wellbore, the safety valve comprising:

a housing for connection into the tubing string;

a flapper valve secured to the housing for movement between an open and a closed position;

valve-operation means for moving the flapper valve from the open to the closed position;

a normal-operation cylinder and piston, the normal-operation piston being stationary relative to the housing and the normal-operation cylinder being movable relative to the normal-operation piston responsive to fluid pressure from a normal-operation fluid pressure source;

a locking cylinder and piston, the locking piston being stationary relative to the housing and the locking cylinder being movable relative to the locking piston responsive to fluid pressure from a locking fluid pressure source;

a normal-operation actuator coupled to the normal-operation cylinder and piston;

a latch coupled to the valve-operation means to selectively and releasably engage the normal-operation actuator;

a locking member coupled to the latch to selectively maintain the valve-operation means stationary relative to the housing, wherein the flapper is maintained in the open position without fluid pressure from the normal-operation and locking fluid pressure sources; and a locking actuator coupled to the locking cylinder and piston to selectively engage the latch and disengage the normal-operation actuator from the latch.

32. The safety valve according to claim 31 wherein the valve-operation means comprises a flow tube longitudinally movable in the housing responsive to movement of one of the normal-operation and locking actuators.

33. The safety valve according to claim 31 wherein the normal-operation cylinder and piston, the normal-operation actuator, the locking cylinder and piston, and the locking actuator are disposed in an annulus defined between the valve-operation means and the housing, away from fluid flow through the safety valve.

34. The safety valve according to claim 31 further including a biasing member coupled between the housing and the valve-operation means to urge the valve-operation means to a fail-safe condition, wherein the flapper is in the closed position.

35. A method of valving to control fluid flow in a tubing string in a wellbore, the method comprising the steps of:

providing a safety valve including:

a valve member movable between an open and a closed position;

a latch member selectively coupled to the valve member to selectively and releasably engage a normal-operation actuator;

a locking dog coupled to the latch member to selectively engage the housing to maintain the valve member stationary relative to the housing, wherein the valve member is maintained in a locked-open position to permit fluid flow through the safety valve; and a locking actuator to selectively engage the latch member to disengage the normal-operation actuator from the latch member;

running a tubing string including the safety valve to a selected depth in the wellbore;

normally operating the safety valve by actuating the normal-operation actuator to engage the latch member and locking dog to selectively open and close the valve member to selectively permit fluid flow through the safety valve;

locking open the safety valve by actuating the locking actuator to engage the latch member and urge the flow tube into a locked-open condition, wherein the flow tube is releasably secured to the housing by the locking dog wherein the valve member permits fluid flow through the safety valve.

36. The method according to claim 35 wherein the safety valve includes an uppermost and a lowermost safety valves connected in series in the tubing string and one of the uppermost and lowermost safety valves is normally operated and another of the uppermost and lowermost safety valves is locked open.

37. The method according to claim 35 further comprising the step of unlocking the safety valve by actuating the normal-operation actuator to engage the latch member and release the valve member from the housing to permit movement between the open and the close position.

38. A method of valving to control fluid flow in a tubing string in a wellbore, the method comprising the steps of:

providing a safety valve including:

a housing for connection into the tubing string;

a valve member disposed in the housing to selectively block fluid flow through the safety valve;

a flow tube disposed in the housing and selectively engageable with the valve member;

a latch member secured to the flow tube to selectively and releasably engage a normal-operation actuator;

a locking dog coupled to the latch member to selectively engage the housing to maintain the flow tube stationary relative to the housing, wherein the valve member is maintained in a locked-open position to permit fluid flow through the safety valve; and a locking actuator to selectively engage the latch member to disengage the normal-operation actuator from the latch member;

running a tubing string including the safety valve to a selected depth in the wellbore;

normally operating the safety valve by actuating the normal-operation actuator to engage the latch member and locking dog to selectively open and close the valve member to selectively permit fluid flow through the safety valve;

locking open the safety valve by actuating the locking actuator to engage the latch member and urge the flow tube into a locked-open condition, wherein the flow tube is releasably secured to the housing by the locking dog wherein the valve member permits fluid flow through the safety valve.

39. The method according to claim 38 wherein the safety valve includes an uppermost and a lowermost safety valves connected in series in the tubing string and one of the uppermost and lowermost safety valves is normally operated and another of the uppermost and lowermost safety valves is locked open.

40. The method according to claim 38 further comprising the step of unlocking the safety valve by actuating the normal-operation actuator to engage the latch member and release the flow tube from the housing.

* * * * *